US006699142B2

(12) United States Patent
Wu

(10) Patent No.: US 6,699,142 B2
(45) **Date of Patent: *Mar. 2, 2004**

(54) GOLF PUTTER HEAD

(75) Inventor: Wan Wu, His-Chih (TW)

(73) Assignee: Fine Earth Enterprise Ltd., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/352,832

(22) Filed: Jan. 28, 2003

(65) Prior Publication Data

US 2003/0144076 A1 Jul. 31, 2003

Related U.S. Application Data

(63) Continuation-in-part of application No. 09/849,459, filed on May 4, 2001, now Pat. No. 6,533,680.

(51) Int. Cl.[7] ..... A63B 53/04

(52) U.S. Cl. ..... 473/340; 473/341

(58) Field of Search ..... 473/313, 340, 473/341, 349, 350, 251

(56) References Cited

U.S. PATENT DOCUMENTS

| | | | | | |
|---|---|---|---|---|---|
| D270,465 | S | * | 9/1983 | Bizovi | D21/742 |
| D324,249 | S | * | 2/1992 | Dahle | D21/743 |
| D402,325 | S | * | 12/1998 | Drossos | D21/742 |
| D414,830 | S | * | 10/1999 | Cleveland et al. | D21/736 |
| 6,533,680 | B2 | * | 3/2003 | Wu | 473/340 |

* cited by examiner

*Primary Examiner*—Sebastiano Passaniti
(74) *Attorney, Agent, or Firm*—J.C. Patents

(57) ABSTRACT

A golf putter head comprises a main head body, a striking surface and a rear part. A cavity is formed at a central part of the rear part, and two protrusions are formed at both ends of the rear face. A base of the cavity is designed into a thin shaped structure. A center of gravity of the putter head is shifted behind the striking surface and the weight of the putter head is shifted to both its ends.

8 Claims, 10 Drawing Sheets

GOLF PUTTER HEAD

CROSS-REFERENCE TO RELATED APPLICATION

This application is a continuation-in-part of prior applications Ser. No. 09/849,459, filed May 4, 2001 now U.S. Pat. No. 6,533,680.

BACKGROUND OF THE INVENTION

1. Field of the Invention

The present invention relates generally to golf putter heads, and more particularly, the present invention relates to a golf putter head with improved forgiveness.

2. Description of the Related Art

The game of golf is a game of accuracy, which is based on the lowest score possible. The score is determined by the number of strokes required to place a golf ball in a cup, which resides on a putting green.

There are several factors affecting the score. One of the biggest factors affecting the score is the use of proper clubs, more particularly the golf putter. The important feature of the golf putter is the putter head. The golf ball must be positioned at the center of the striking face of the putter head or the sweet spot, and the sole of the putter head must be parallel to the putting surface, so that an accurate hit can be achieved. Therefore, a well-designed golf putter head should include features that promote accuracy, consistency and forgiveness to minor errors. Two main errors that occur during striking are off center hits and miss hits.

FIG. 1 illustrates a schematic front view of a conventional putter head. The conventional putter head 100 has a striking face 101 consisting of two parallel markings 102, which indicates a sweet spot region 103 of the putter head 100. A point C located within the sweet spot region 103 indicates the center of gravity of the putter head 100, which also indicates an ultimate point at the striking face for hitting the golf ball. However, when the golf ball is not positioned at the ultimate point of the striking face of the putter head, the golf ball will miss the target line, thus an off center hit results. FIG. 2 shows a schematic top view of the putter head 100 having an ultimate point A. For a golf ball 202 to be on a target line 200, the golf ball 202 must be located at the ultimate point A of the putter head 100. But if the golf ball is hit at a wrong position, such as point B instead of the ultimate point A, the golf ball 202 will be off set away from the target line 200. A path line 201 shows how the golf ball 202 travels when it is being stroked at the wrong position of the putter head. Due to the rotation motion of the golf ball 202, the greater the distance the golf ball travels, the bigger the offset error away from the target line 200, which is shown by comparing the path line 201 and the target line 200. However, FIG. 3 indicates that when the golf ball 202 is at the ultimate point A but the sole of the putter head is at an angle$\beta$ to the putting surface instead of parallel to the putting surface, the golf ball will miss the target line and travels along a path line 301, which is off set away from the target line 200. Thus a miss hit results.

As a matter of fact, a variety of putter heads have been developed which improve striking accuracy, reduce the errors and assist the golfer in visually determining the proper position of the putter head with respect to the golf ball, target line and putting surface. However, the forgiveness of the putter head is not much improved and offcenter hits still occur. Many conventional putter heads have markings, lines, grooves or material layers that assist the golf player in aligning the ball at the sweet spot of the striking face and aligning the striking face perpendicular to the target line. The material layer formed on the sweet spot, which is made of plastic or polymer, can increase cohesiveness between the sweet spot area and the golf ball. In order to achieve proper putter head alignment and position, the golfer must visually center the rearward extension between the two parallel markings. However, the accuracy of this positioning method is dependent on the golf player's own perception of whether the extension is centered between the markings. Errors often occur when attempting to accurately center the extension between the two markings, resulting in the improper positioning of the putter head, miss hits and off center hit putts. Even if the golf ball is positioned at the sweet spot of the putter head, if the striking angle of the golf club is offset, the golf ball will travel away from the target line and miss hit putts will still result. Therefore, conventional golf putter heads still face the problem of miss hits and off center hits.

SUMMARY OF THE INVENTION

It is an object of the present invention to provide a putter head that can improve the forgiving ability.

It is further another object of the present invention to provide a putter head that reduces the problem of miss hits and off center hits.

A golf putter head comprises a main head body, a striking surface and a rear part. A cavity is formed at a central part of the rear part, and two protrusions are formed evenly at both ends of the rear part. A striking portion is designed into a thin shaped structure, so that the center of gravity of the putter head is shifted behind the striking surface. The base of the cavity can be designed a sloped-shaped structure comprising an upper section, a central section and a lower section.

According to one aspect of the present invention, a thickness of the upper section is approximately between 0.4 mm to 1.5 mm, a thickness of the central section is approximately between 1.0 to 10 mm and a thickness of the lower section is approximately between 1 mm and 2.3 mm. It goes without saying that the central section is disposed in the central region of the base of the cavity. A loft angle of the base of the cavity is approximately between 0° to 7° but is preferably at 4° from a clockwise direction.

According to another aspect of the present invention, a thickness of the upper section is thicker than the lower section. A thickness of the upper section of the base is approximately between 1 mm to 2.3 mm, a thickness of the central section is between 1.0 to 10 mm, and the thickness of the lower section is approximately between 0.4 mm to 1.5 mm. A loft angle$\theta$ is approximately −1° from a clockwise direction.

According to another aspect of the present invention, the shape of the central section may comprise, but not limited to a circle, oval, rectangle, and diamond shape. The surface of the central section may cover a surface area of the base of the cavity shape ranging from anywhere between 0 the whole surface area of the base of the cavity, and preferably between ¼ to ½ the surface area of the base of the cavity.

Both the foregoing general description and the following detailed description are exemplary and explanatory only and are not restrictive of the invention, as claimed.

According to another aspect of the present invention, the base of the cavity may be manufactured by using a casting method or a wax-off method.

BRIEF DESCRIPTION OF THE DRAWINGS

The accompanying drawings are included to provide a further understanding of the present invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

The present invention provides an improved putter head and a fabrication method thereof. The present invention utilizes shifting the weight of the putter head to its head and toe ends together with a extremely thin structure design at its center part in order to prevent the miss hit and off center hit problems, and improve the forgiveness and accuracy.

Figure 1:
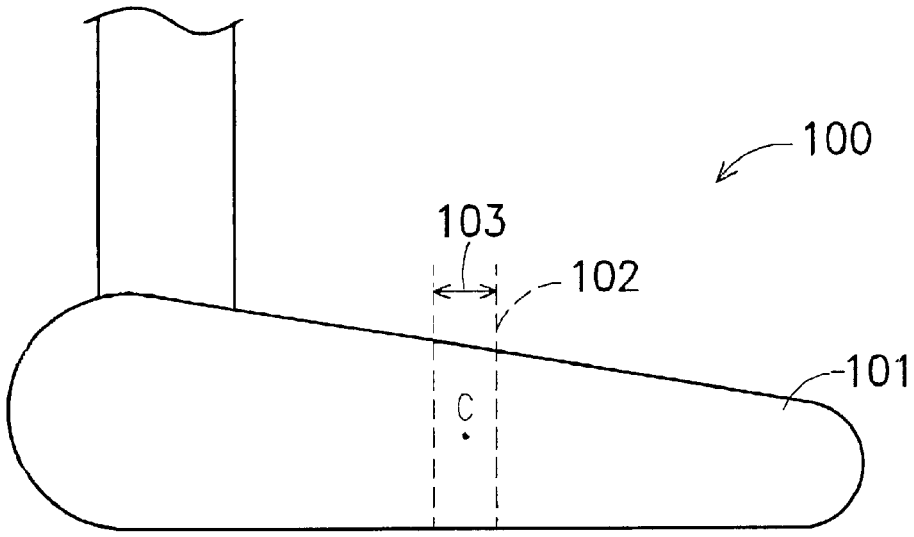
FIG. 1 is a schematic front view of a conventional putter head.
Figure 2:
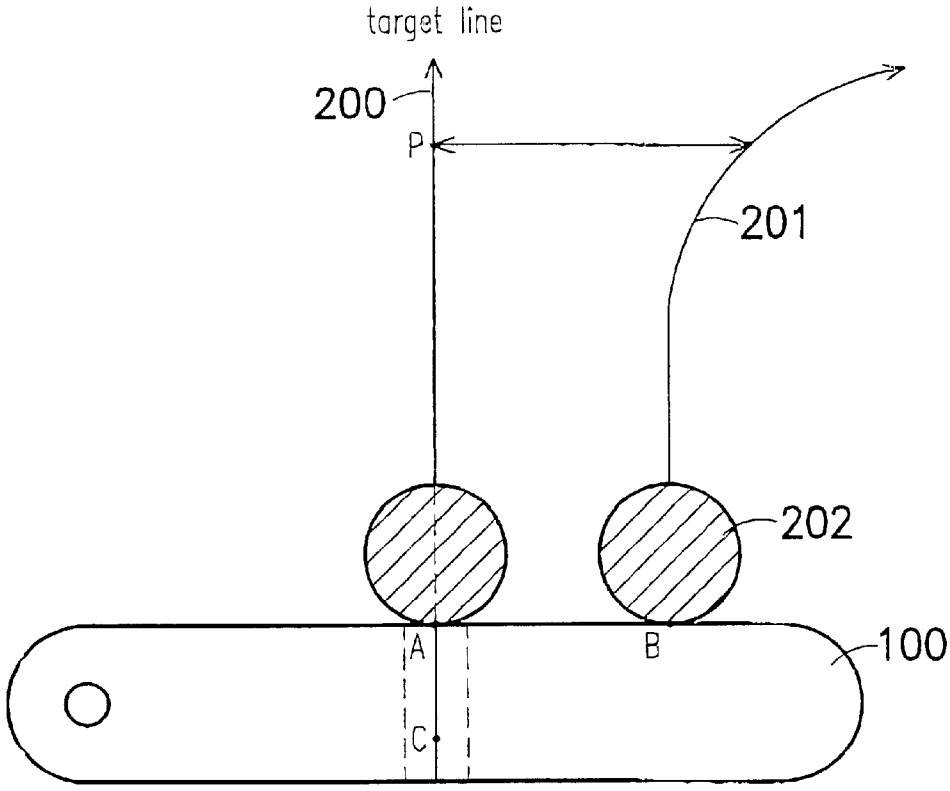
FIG. 2 is a schematic top view of an off center hit caused by a conventional putter head.
Figure 3:
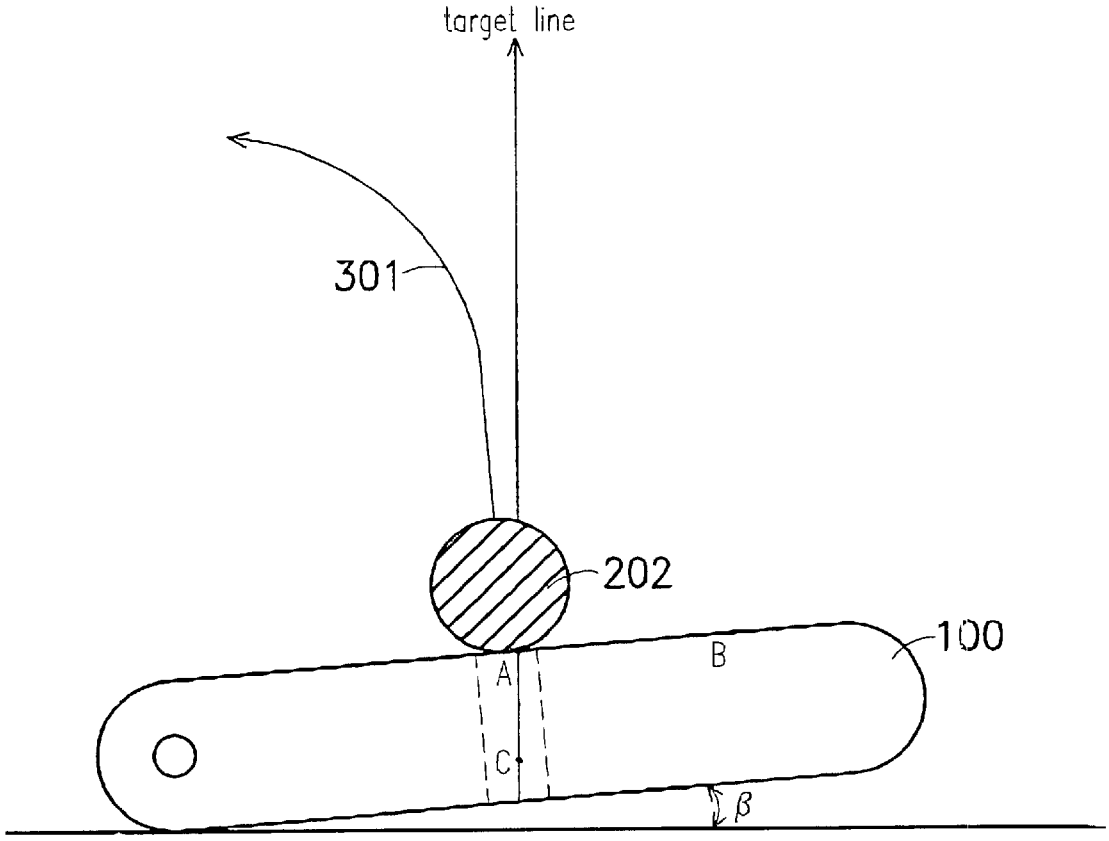
FIG. 3 is a schematic top view of a miss hit caused by a conventional putter head.
Figure 4:
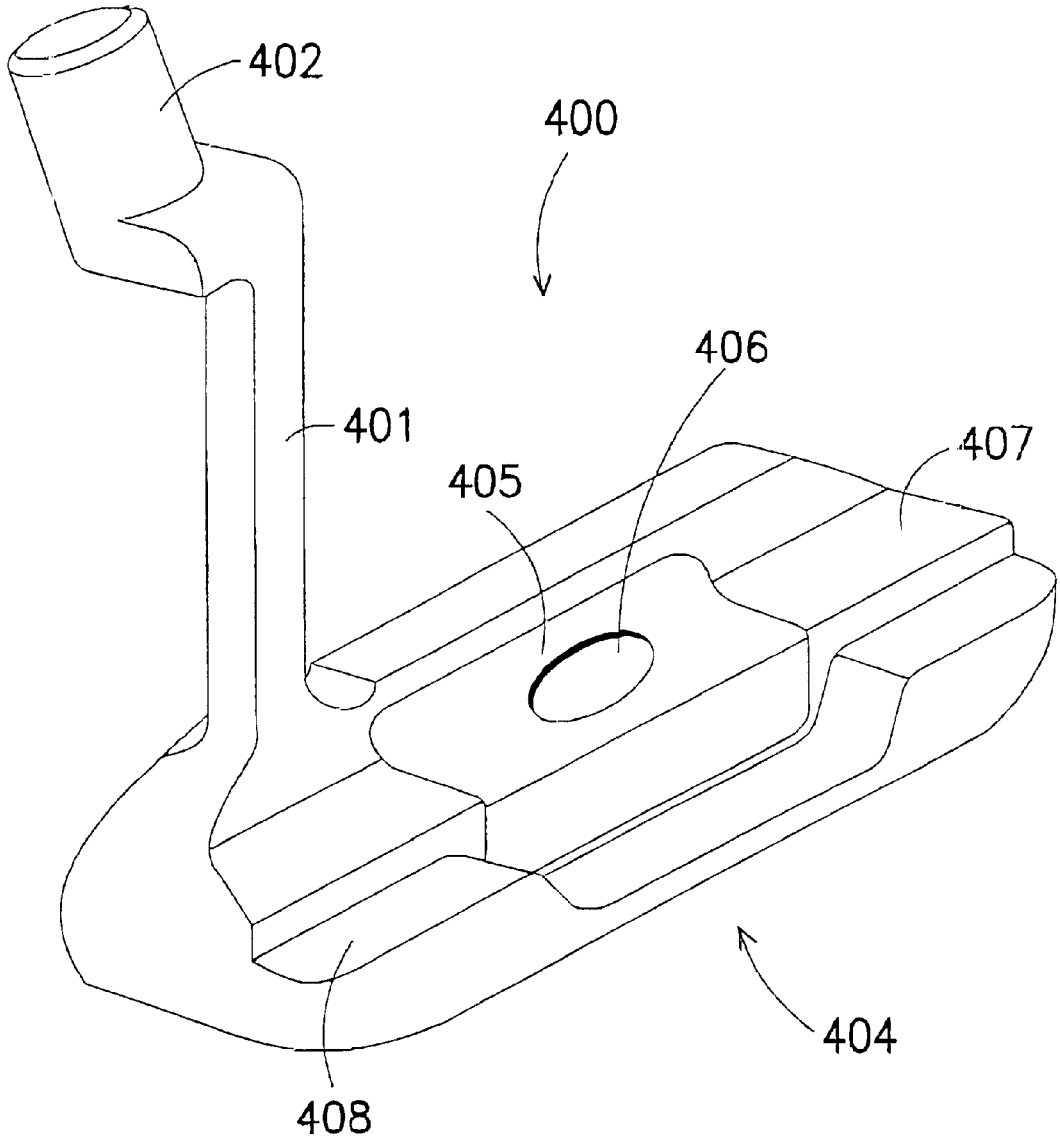
FIG. 4 is a schematic 3-D view of a putter head of the present invention.

FIG. 4 illustrates a schematic view of a putter head of the present invention. Referring to FIG. 4, a putter head comprises a main body 400 with a neck portion 401, a striking surface (not shown) and a rear part 404. The neck portion 401 provides a top sleeve 402 for inserting a golf shaft. The rear part 404 comprises a cavity 405 at the center of the rear part and two portions of protrusions 406 and 407 at its head end and toe end. The base of the cavity 405 comprises a central section 406. The purpose of the two protrusions 407 and 408 at the head end and toe end is to shift the major weight of the putter head evenly at both its ends.

Figure 5A:
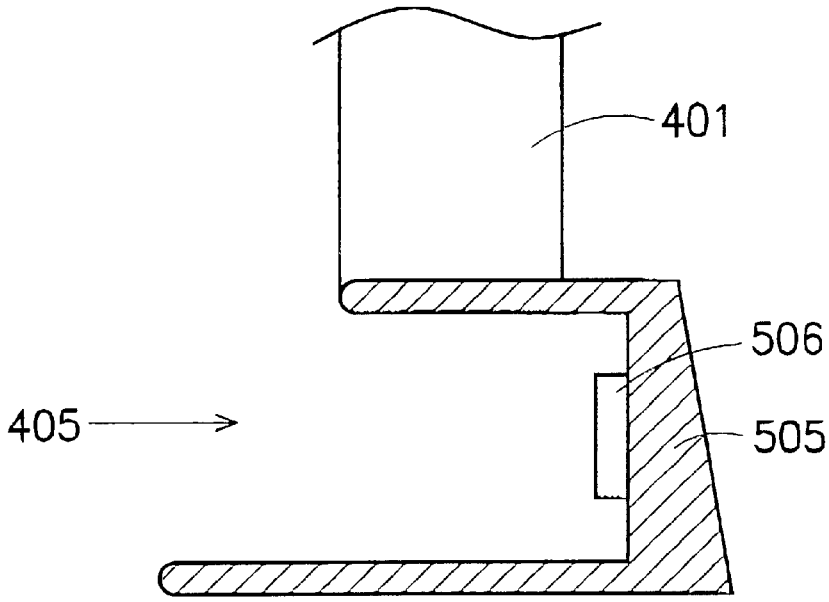
FIG. 5*a* is a cross-sectional view of a putter head according to one preferred embodiment of the present invention.
Figure 5B:
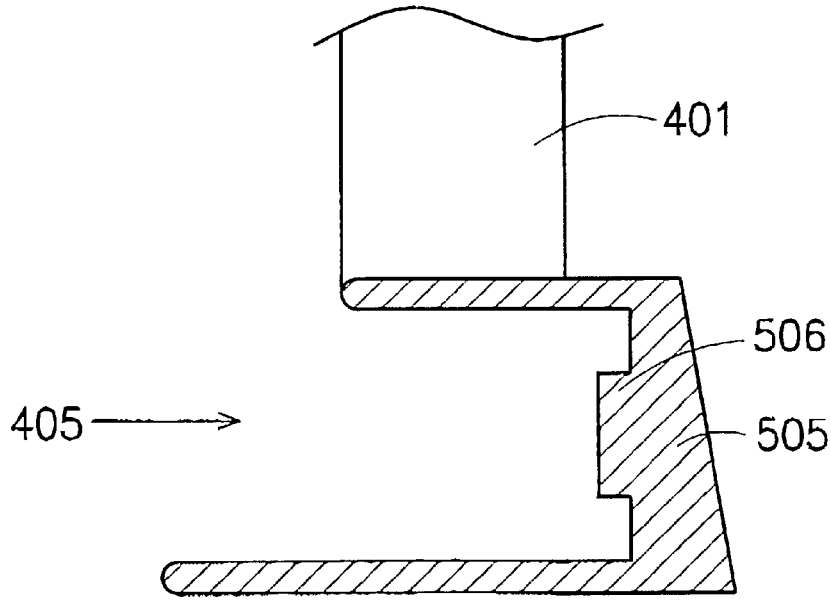
FIG. 5*b* is a cross-sectional view of a putter head according to another preferred embodiment of the present invention.
Figure 6A:
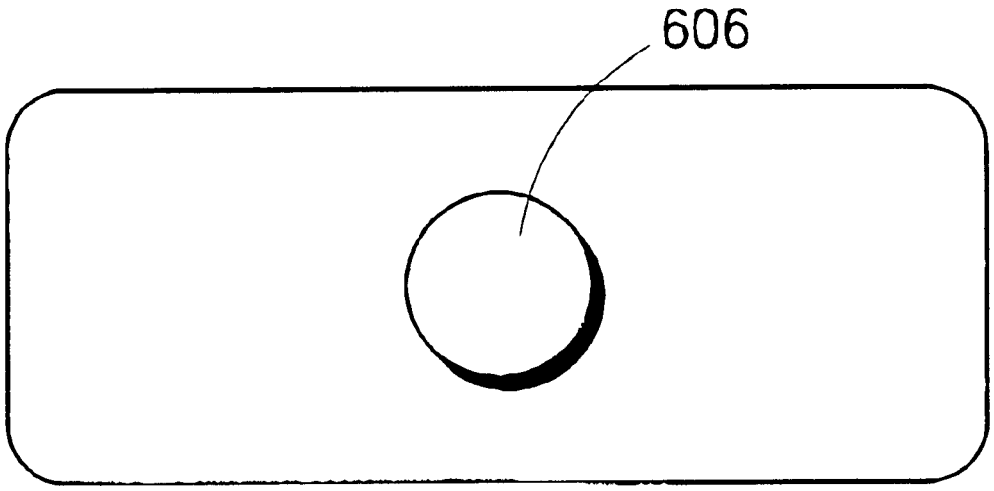
FIGS. 6*a*–6*d* shows the different shape of the central section of the putter head of the present invention.
Figure 6B:
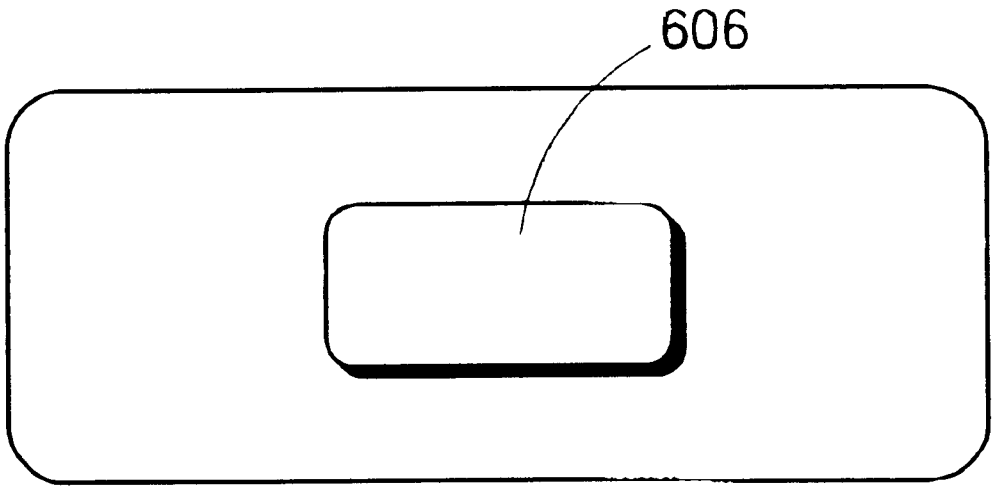
Figure 6C:
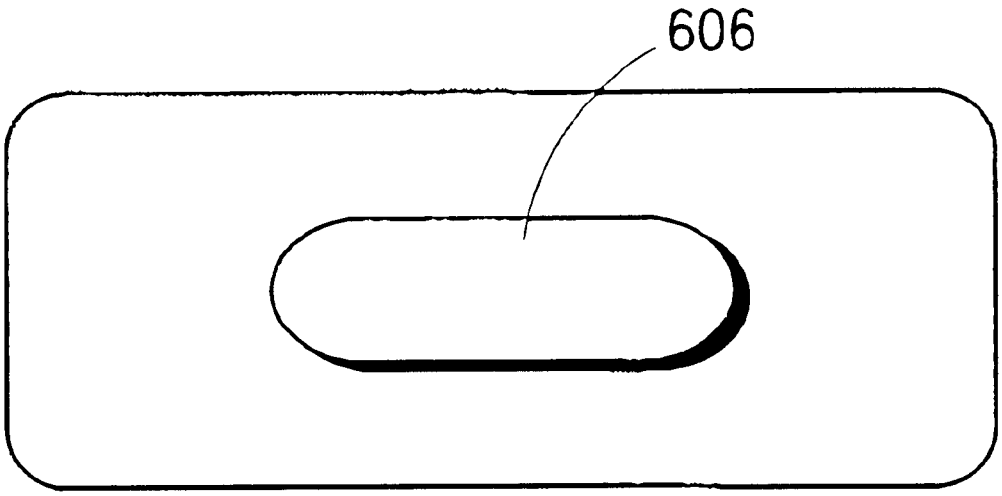
Figure 6D:
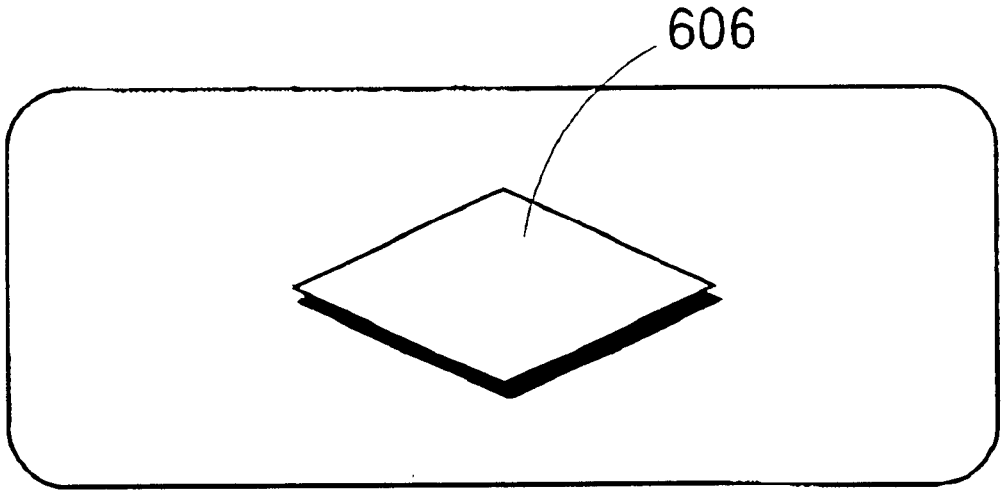

FIG. 5*a* and 5*b* are schematic cross sectional views of a putter head of the present invention, and FIG. 6 illustrates a magnified cross-sectional view of a base 505 of FIG. 5. Referring to FIG. 5*a*, the central section 506 is adhered to the central part of the base 505 of the cavity. Now turning to FIG. 5*b*, the central section 506 is manufactured as an integral piece together with the base 505 of the cavity.

The cavity 405 of the rear part 404 in FIG. 4 has a base 505, which is the structure shown in FIG. 5*a* and 5*b*. Since the center portion of the rear part 404 is formed into the cavity 405 with an extremely thin base 505, the major weight of the putter head is shifted to its both ends. The putter head of the present invention is designed in such a way that the center of gravity of the putter head is shifted behind the striking face. When the center of gravity is shifted behind, the golf ball can be hit at the sweet spot of the putter head easily. Therefore, the forgiveness of the putter head is extremely improved.

Figure 7:
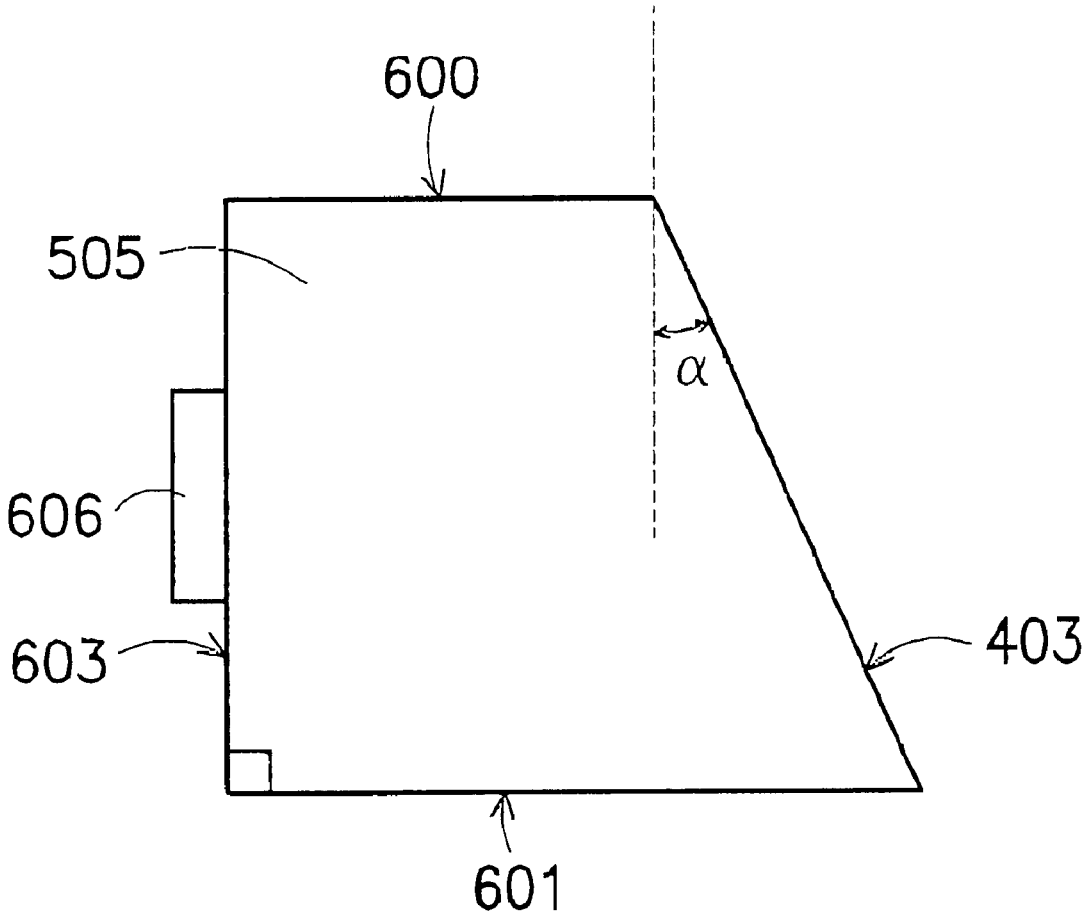
FIG. 7 is a magnified cross-sectional view of a part 505 of FIG. 5A in accordance with a preferred embodiment of the present invention.

Referring to FIG. 7, the base 505 is a structure having an upper section 600, a central section 606, and a lower section 601, in which a thickness of the upper section 600 is thinner than the lower section 601. A loft angle$\alpha$ is an angle between a bottom surface 603 and the striking surface 403. The loft angle$\alpha$ is approximately between 0° to 7° but is preferably at 4° from a clockwise direction. The thickness of the upper section 600 of the structure is approximately between 0.4 mm to 1.5 mm, a thickness of the central section 606 is approximately 1.0 to 10 mm, and the thickness of the lower section 601 of the structure is approximately between 1 mm to 2.3 mm. A surface area of the central section may range anywhere between 0 to the whole surface area of the base 505 of the cavity. The design of the base 505 not only improves the forgiveness, but also provides a better putter surface. The design of the putter head improves the accuracy of striking hits, even if the striking angle is off set.

FIG. 6*a* to 6*d*, shows different shape of the central section 606 of the base 505 of the cavity. The central section 606 is positioned inside the cavity. A shape of the central section may comprise, but not limited to, a circle, an oval, a rectangle, or a diamond shape.

Figure 8A:
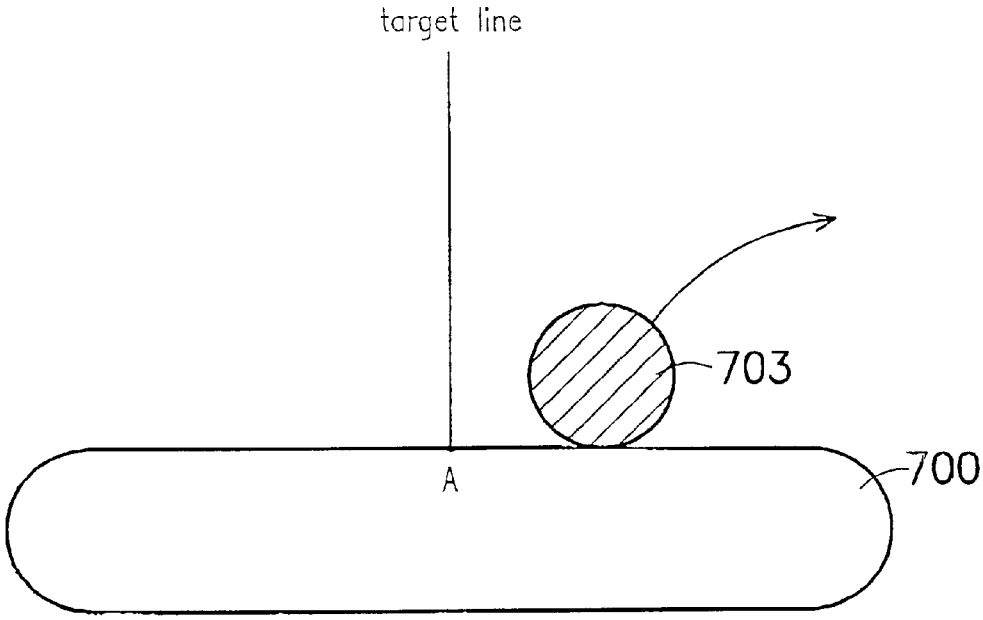
FIG. 8a(PRIOR ART)
FIG. 8*a* is a schematic top view of a conventional putter head.
Figure 8B:
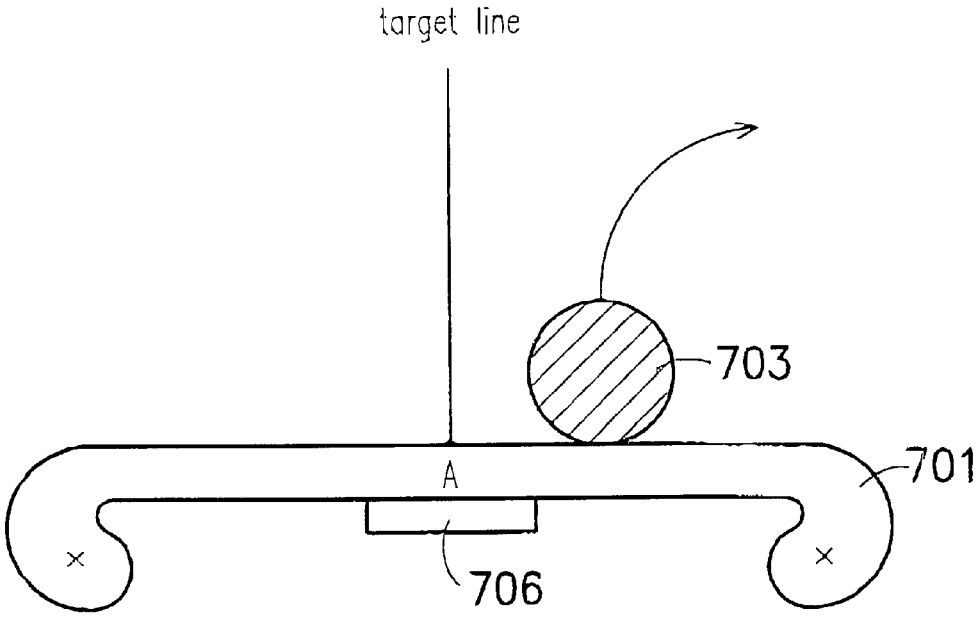
FIG. 8*b* is a schematic top view of a putter head of the present invention.

The characteristics of the present invention can be explained by comparing the conventional design to the inventive design. FIG. 8*a* shows a conventional design of a putter head 700, which has its weight equally distributed throughout its structure. If a golf ball 703 is not positioned at its sweet spot A when a striking force is applied, the conventional putter head 700 will rotate easily at an angle, resulting in a miss hit. However, FIG. 8*b* showing a putter head 701 of the present invention, which has its major weight shifted to both ends. If the golf ball 703 is not at the sweet spot A when a striking force is applied, the putter head 701 will not rotate easily, and the putter head 701 will still be able to be parallel to the putting surface. Thus a miss hit can be reduced. Since the putter head of the present invention can reduce the degree of the golf ball off set away from the target line, therefore the forgiveness of the present invention is greatly improved.

Figure 9A:
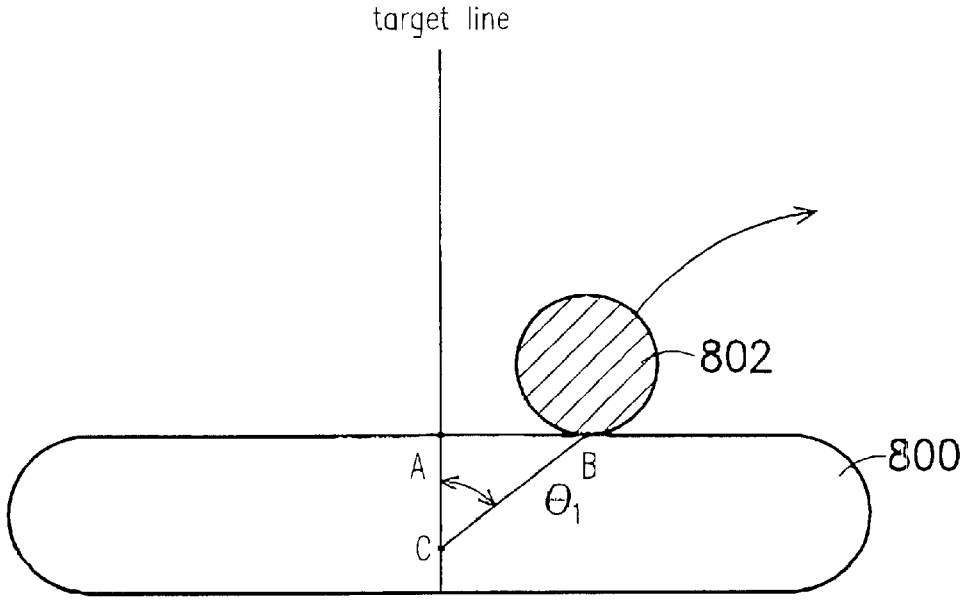
FIG. 9a(PRIOR ART)
FIG. 9*a* is a schematic top view of a conventional putter head.
Figure 9B:
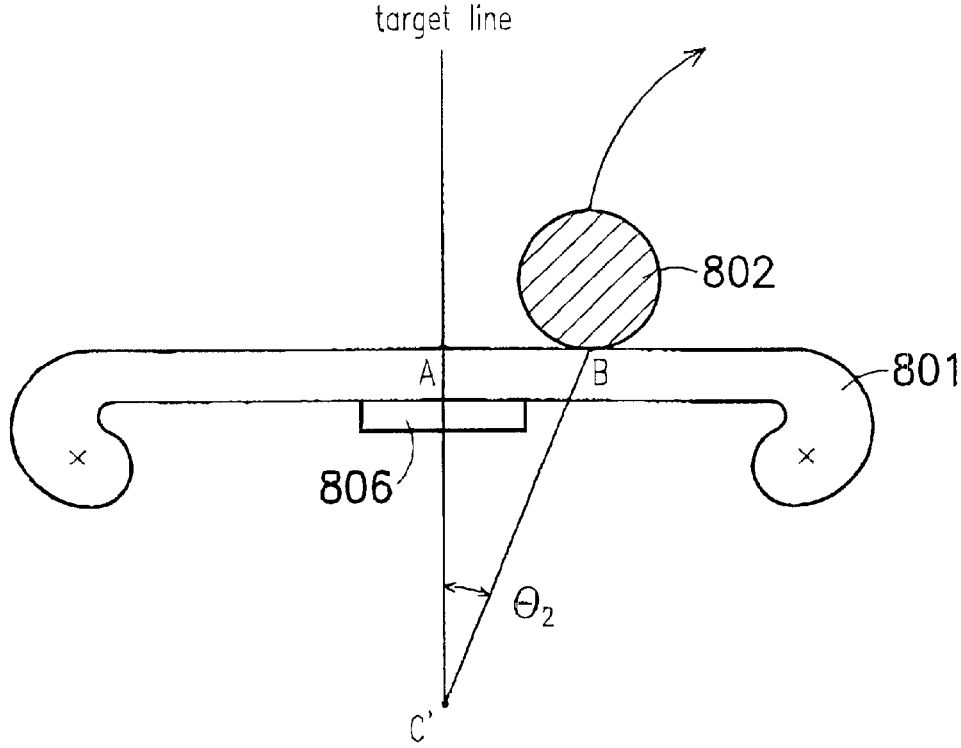
FIG. 9*b* is a schematic top view of a putter head of the present invention.

FIG. 9*a* is a conventional design of a putter head 800, which has a center of gravity at point C and a sweet spot at point A. When a golf ball 802 is hit at a point B instead of the sweet spot point A, an error angle$\theta_1$ occurs, and resulting in the golf ball 802 being off set away from the target line. An off center hit thus results. FIG. 9*b* is a putter head of the present invention. The putter head 801 has a center of gravity at point C', which is shifted behind the striking surface. Since the center of the gravity of the putter head is shifted further away from striking face, a distance between the sweet spot A to the center of gravity point C' is increased. When a golf ball 802 is hit at a point B instead of the sweet spot point A, an error angle$\theta_2$ occurs. However, since the center of gravity C' of the present invention 801 is much farther away from the striking surface than the center of gravity C of the conventional putter head 800, and the distance between the sweet spot A to the center of gravity point C' is also increased. Therefore, the error angle$\theta_2$ is much smaller than the error angle$\theta_1$, the error of off set is reduced. Thus, the forgiveness of the putter head of the present invention is improved.

However, the present invention is not limited to the shape of the base 505. By utilizing the principle of shifting the weight of the putter head to both its ends and shifting the center of the cavity behind the striking surface, the present invention can be designed with different shapes of the structure based on the same principle.

Figure 10:
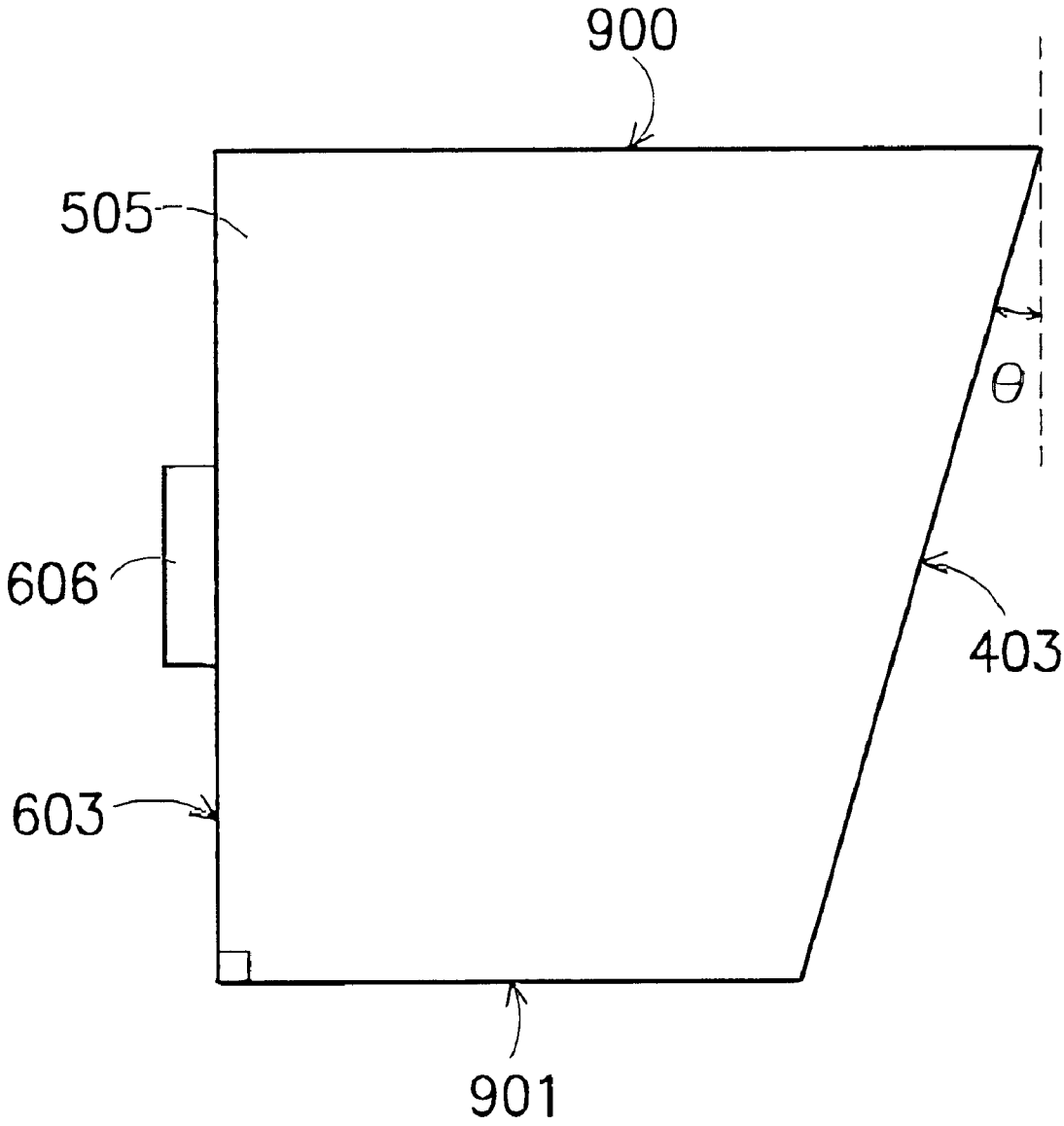
FIG. 10 is a magnified cross-sectional view of a part 505 of FIG. 5 in accordance with another preferred embodiment of the present invention.

FIG. 10 illustrates a magnified cross-sectional view of the portion 505 of FIG. 5*a* in accordance with another preferred embodiment of the present invention. Referring to FIG. 10, the base 505 is a structure having an upper section 900, a central section 606 and a lower section 901, in which a thickness of the upper section 900 is thicker than a lower section 901. A loft angleθ, which is an angle between a bottom surface 603 and the striking surface 403 is approximately −1° from a clockwise direction. A thickness of the upper width 900 of the base 505 is approximately between 1 mm to 2.3 mm, a thickness of the central section 606 is approximately between 1.0 mm to 10 mm, and a thickness of the lower section 901 of the base 505 is approximately between 0.4 mm to 1.5 mm. Although, the shape of the base 505 is different, it still is based on the same principle; therefore, the putter head still provides the same functions and advantages. However, the base 505 cannot be thinner less than 0.4 mm because if the base 505 is less than 0.4 mm, a distortion will occur. The base 505 also cannot be thicker than 2.3 mm because it the base 505 is thicker than 2.3 mm, the forgiveness is extremely reduced.

The putter head of the present invention is made of a metal that can be casting, wax-off or forging such as soft steel, soft iron or a metal consisting of S25C. A forging process is utilized as an example to disclose the present invention; however, the present invention is not limited to the forging method only. A cylindrical shaped metal is first provided. The cylindrical shaped metal is then subjected to high pressure pressing, so that the metal is formed into a basic putter head shape. A computer numerical control (CNC) method is performed to shape the putter head to its detail. Due to the high pressure pressing, the crystal lattice structure of the putter head is compressed into a high density and very hard structure. Therefore, the putter head of the present invention provides powerful hitting ability, and though even the thickness of the base of the cavity is very thin, the putter head of the present invention can still be subject to the hitting force and pressure without distortion.

The advantages of the putter head of the present invention are the great improvement of accuracy, consistency and forgiveness due to the fact that the center of gravity of the putter head is shifted behind the striking surface and the area of the putter head is evenly distributed at both its ends. The distance between the striking surface to the center of gravity point is also increased. Therefore, the error angle is greatly reduced. The golf ball can be hit at the center area of the putter head, and even if the striking angle is slightly off set, the golf ball will still be in its target line. Therefore, miss hit and off center hit problems can be prevented; thus the forgiveness of the golf club is greatly improved.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A golf putter bead comprising:

a main head body having a striking surface and a rear part, a central part of the rear part having a cavity and the cavity has a slope-shaped base with an upper section, a central section and a lower section, the upper section is thinner than the lower section, wherein the thickness of the upper section being approximately between 0.4 mm to 1.5 mm, a thickness of the central section is approximately between 1.0 to 10 mm, and the thickness of the lower section is approximately between 1 mm and 2.3 nun; and two protrusions formed at both ends of the rear part.

2. The golf putter head of claim 1, wherein the central section comprises a shape of a circle, an oval, a rectangle, or a diamond.

3. The golf putter head of claim 1, wherein the central section has a surface covering a surface area of the slope-shaped base ranging from 0 to the whole surface area of the slope-shaped base.

4. The golf putter head of claim 1, wherein the base of the cavity has a loft angle that is approximately between $0^0$ to $7^0$ from a clockwise direction.

5. The golf putter head of claim 1, wherein the base of the cavity has a loft angle of preferably $4^0$ from a clockwise direction.

6. The golf putter head of claim 5, wherein the putter head is fabricated by a computer numerical control method.

7. The golf putter head of claim 1, wherein the putter head is fabricated by a metal material that comprises soft iron S25C.

8. The golf putter head of claim 1, wherein the putter head is fabricated by a forging a method.

* * * * *